US006016725A

United States Patent [19]

Tillitski

[11] Patent Number: 6,016,725

[45] Date of Patent: Jan. 25, 2000

[54] COMBINATION WRENCH

[76] Inventor: Stephan Tillitski, 650 Riverbottom Rd, Athens, Ga. 30605

[21] Appl. No.: 09/119,203

[22] Filed: Jul. 20, 1998

[51] Int. Cl.[7] ..... B25B 13/00

[52] U.S. Cl. ..... 81/125.1; 81/121.1

[58] Field of Search ..... 81/119, 121.1, 81/124.2, 124.3, 124.7, 125.1, 448

[56] References Cited

U.S. PATENT DOCUMENTS

| | | | |
|---|---|---|---|
| 518,328 | 4/1894 | Oakey | 81/119 X |
| 1,557,726 | 10/1925 | Rankin | 81/119 |
| 1,709,417 | 4/1929 | Uhlman et al. | 81/119 |
| 2,334,069 | 11/1943 | Collins et al. | 81/119 |
| 2,763,175 | 9/1956 | Heimark | 81/119 X |

*Primary Examiner*—James G. Smith
*Assistant Examiner*—Anthony Ojini
*Attorney, Agent, or Firm*—Gardner & Groff, P.C.

[57] ABSTRACT

A combination wrench for threading and unthreading a J-shaped lag screw into trees, telephone poles, and the like includes an elongate wrench shaft having first and second opposite ends and a substantially closed loop adjacent the first end. The closed loop is adapted to be looped over an end of the J-shaped lag screw to allow the J-shaped lag screw to be turned. A hook is formed adjacent the second end of the elongate wrench shaft and is adapted to be removably hooked into the J-shaped lag screw to enable the lag screw to be turned. The hook and the loop are each offset from the elongate wrench shaft to provide hand clearance.

10 Claims, 2 Drawing Sheets

COMBINATION WRENCH

TECHNICAL FIELD

The present invention relates to a combination wrench and in particular relates to a combination wrench for use in threading a J-shaped lag screw into and out of a tree, telephone pole, or the like.

BACKGROUND OF THE INVENTION

In many situations, it is important to screw a lag screw into a tree, telephone pole, etc. Such a lag screw can take the form of a headed bolt, an eyelet screw, a J-shaped lag screw, etc. In the case of a J-shaped lag screw, a special problem exists. For example, one could use a pry bar or large screwdriver to try to thread the J-shaped lag screw into the tree. However, in doing so, the shaft of the pry bar or large screwdriver is only loosely held within the foot (the barbed end portion) of the J-shaped lag screw. Thus, as the user attempts to turn the J-shaped lag screw, the pry bar or large screwdriver can slip out of the foot of the lag screw. This can present a significant inconvenience or even a safety hazard inasmuch as the lag screw is often being threaded into the tree, pole, etc. at a substantial distance above the ground. Thus, should the tool being used to thread the lag screw into the tree slip, there is the very real possibility that the user will drop the tool to the ground. This presents a significant inconvenience inasmuch as it requires the user to descend to retrieve the tool, ascend again, and to start work again. This is very time consuming and frustrating. Moreover, another person or other equipment may be below the user and could be injured or damaged by the falling tool.

It should be noted as well that as the J-shaped lag screw is threaded into the tree into a position in which the outer surface of the tree closes off the foot of the J-shaped lag screw, the situation, as far as the tool is concerned, changes significantly. With the lag screw only part way threaded into the tree, there is nothing to prevent the pry bar or large screw driver from slipping out of the foot, leading to the problems mentioned above. On the other hand, as the J-shaped lag screw is-threaded into the tree fully, the very tip of the foot of the J-shaped lag screw comes into contact with the outer surface of the tree, thereby closing the foot on all sides. This essentially constrains radial movement of any tool in the foot of the J-shaped lag screw. While this makes it easier to turn the J-shaped lag screw into or out of the tree, depending upon the end configuration of the tool being used, the tool might undesirably be captured by the tree and the lag screw.

Accordingly, it can be seen that a need yet remains for a tool for threading a J-shaped lag screw into a tree, telephone pole, etc. which minimizes the risk that the tool will be dropped during use and which is highly effective both when the J-shaped lag screw is fully threaded into the tree and when the J-shaped lag screw is only partly threaded into the tree. It is to the provision of such a tool that the present invention is primarily directed.

SUMMARY OF THE INVENTION

Briefly described, in a first preferred form the present invention comprises a combination wrench for threading and unthreading a J-shaped lag screw into a tree, telephone pole, and the like. The combination wrench comprises an elongate wrench shaft having first and second opposite ends. A substantially closed loop is adjacent the first end and is adapted to be looped over an end of the J-shaped lag screw to enable a user of the combination wrench to turn the J-shaped lag screw. At the other end of the elongate wrench shaft is a hook to enable a user of the combination wrench to turn the J-shaped lag screw. The hook can be removably hooked into the J-shaped lag screw.

With this construction, much of the threading and unthreading of a J-shaped lag screw into and out of a tree, pole, or the like can be accomplished with the substantially closed loop looped over the end of the J-shaped lag screw to prevent the combination wrench from falling to the ground should the user's hands slip off the wrench. Moreover, when the J-shaped lag screw is substantially threaded into the tree, pole, or the like, the substantially closed loop can be slipped off the end of the foot of the J-shaped lag screw and the wrench turned around to utilize the hook portion. The hook can be slipped into the foot of the J-shaped lag screw and the J-shaped lag screw can be threaded the remaining way into the tree, pole, or the like. Once the J-shaped lag screw is fully threaded into the tree, pole, etc., the hook can be removed from the foot of the J-shaped lag screw rather easily.

Preferably, the hook and the loop are each offset from the elongate wrench shaft to provide hand clearance as the wrench is utilized to turn a J-shaped lag screw in one direction or the other. Preferably, the hook and the loop are each oriented at an angle relative to a longitudinal axis of the elongate wrench shaft. In a modified form of the invention, preferably the hook and the loop are each oriented to be parallel and spaced from a longitudinal axis of the elongate wrench shaft.

Preferably, the loop is in the form of a closed eyelet. Also preferably, the hook is in the form of a semi-circle.

The present invention has numerous advantages over the known art. For example, the novel combination wrench allows for rapid and secure threading and unthreading of a J-shaped lag screw. It is also highly effective when the lag screw is only partly threaded into the tree or when the lag screw is fully or almost fully threaded into the tree. Moreover, in the event that the user's hand(s) should slip from the combination wrench, the likelihood that the combination wrench will fall to the ground is substantially diminished, thereby providing greater safety and convenience. Furthermore, the combination wrench is an elegantly simple solution to the problem of threading and unthreading J-shaped lag screws. It is easily manufactured, is durable in its construction, and is simple in its operation.

Accordingly, it is a primary object of the present invention to provide a combination wrench for threading and unthreading a J-shaped lag screw into a tree, pole, or the like.

It is another object of the present invention to provide a combination wrench for threading and unthreading a J-shaped lag screw into and out of a tree, pole, or the like and which is convenient and safe to use.

It is another object of the present invention to provide a combination tool for threading and unthreading a J-shaped lag screw into and out of a tree, pole, or the like which is economical to manufacture, durable in use and simple in its operation.

It is another object of the present invention to provide a combination wrench for threading and unthreading a J-shaped lag screw into and out of a tree, pole, or the like which is effective both when the J-shaped lag screw is only partly threaded into the tree or is entirely or substantially entirely threaded into the tree.

These and other objects, features, and advantages of the present invention will become more apparent to those skilled in the art upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
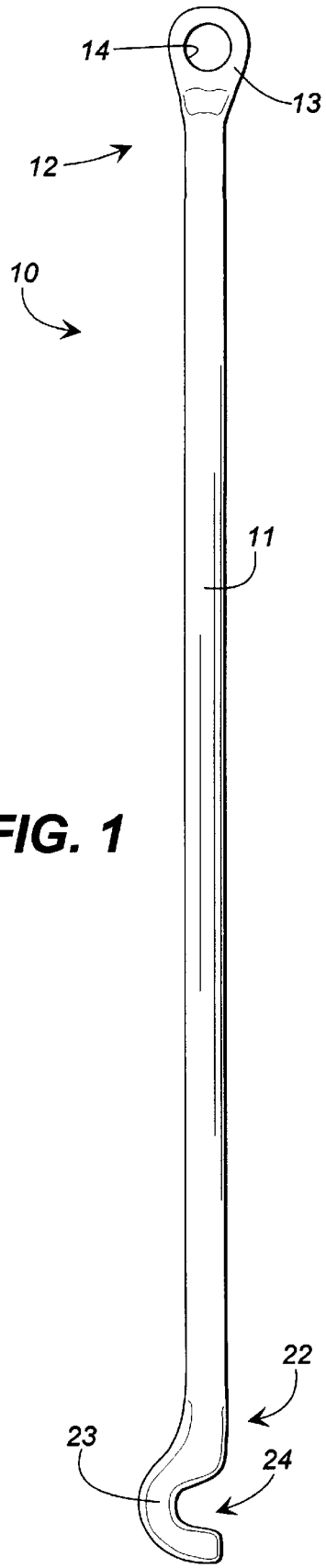
FIG. 1 is a front view of a combination wrench according to a preferred form of the invention.
Figure 2:
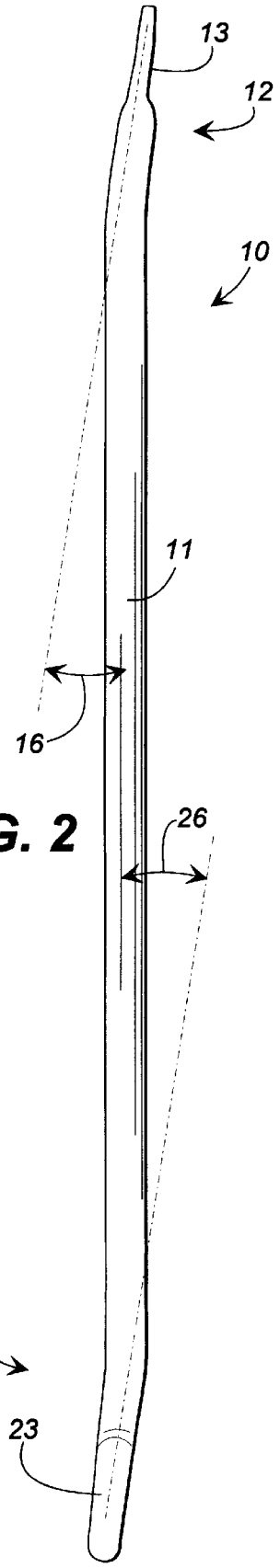
FIG. 2 is a side view of the combination wrench of FIG. 1.
Figure 3:
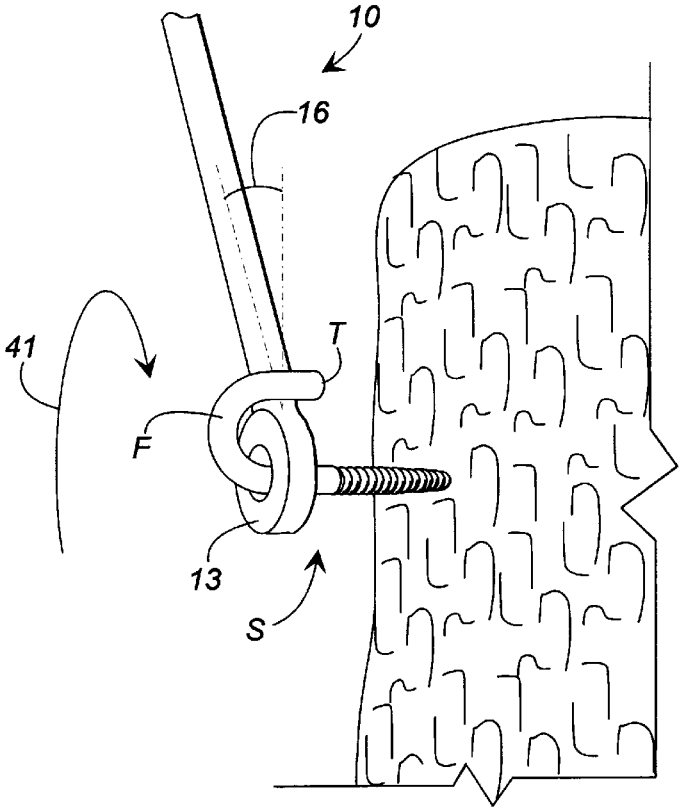
FIG. 3 is a perspective illustration of the combination wrench of FIG. 1 shown in one mode of use in threading a J-shaped lag screw into the trunk of a tree.
Figure 4:
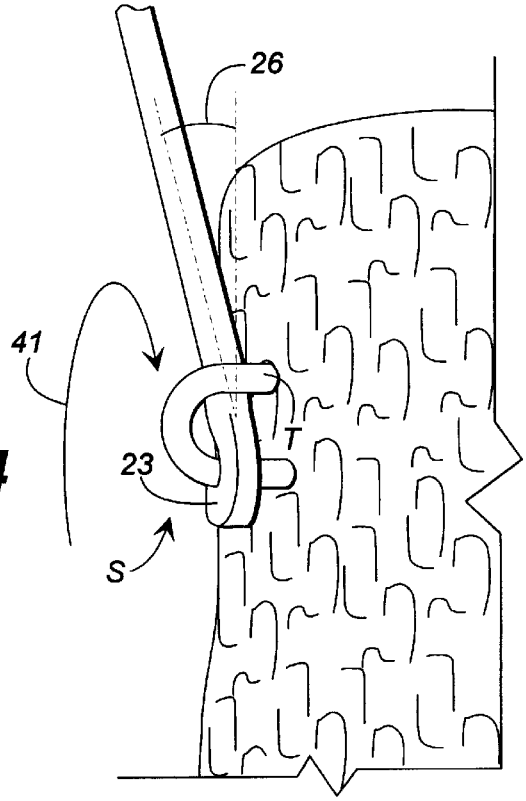
FIG. 4 is a perspective illustration of the combination wrench of FIG. 1 showing another mode of operation of the combination wrench to thread a J-shaped lag screw into the trunk of a tree.

Referring now in detail to the drawing figures, wherein like reference numerals represent like parts throughout the several views, FIGS. 1 and 2 show a combination wrench 10 according to a preferred form of the invention. The combination wrench 10 is provided for use in threading and unthreading J-shaped lag screws into tree trunks, telephone poles, and the like, such as is depicted in FIGS. 3 and 4 and as will be described in more detail in connection therewith. The combination wrench 10 is made out of a unitary piece of steel and includes an elongate central shaft or handle 11. The elongate central handle 11, in the commercial embodiment, preferably is about 24 inches long and about ¾ inches in diameter. It will be understood by those skilled in the art, however, that the specific dimensions of the combination wrench can be varied as required.

At a first end 12 of the elongate central handle 11 is formed a closed loop end 13 having a central opening 14. As can be seen in FIG. 2, the closed loop 13 is oriented at an offset angle 16 with respect to a longitudinal axis of the elongate central handle 11. Preferably, this angle is about 5 degrees. The purpose of this angle to provide clearance for a worker's hands in utilizing the tool as the tool is turned around and around. This provides clearance as the tool and the user's hands thereon are brought past the trunk of the tree. Otherwise, there would be a tendency for the user's hands to scrape the tree, thereby making the tool somewhat injurious, cumbersome, and less practical.

Positioned opposite to end 12 of the elongate central handle 11 is another end 22. A semi-circular hook 23 is formed adjacent end 22 and includes an open side indicated at 24. The hook 23 is oriented at an offset angle 26 of approximately 5 degrees with respect to the longitudinal axis of the elongate central handle 11. It is pointed out that the offset angles 16 and 26 are identical, although they could be varied from one another if desired.

Figure 5:
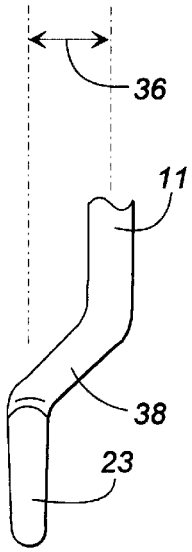
FIG. 5 is a front view of a portion of a combination wrench according to a modified form of the present invention.

FIG. 5 shows an alternate arrangement in which, instead of having the closed loop 13 and the hook 23 arranged at an offset angle, they are arranged by an offset displacement distance. As shown by way of example, the hook 23 is offset a displacement distance 36. The displacement is achieved by joggling the hook 23 from the elongate central handle 11. This results in an angled leg 38 connected to the elongate central handle 11 and the hook 23. The displacement or offset of the closed loop 13 is substantially identical and need not be described further herein.

Referring now to FIGS. 3 and 4, the threading of a J-shaped lag screw S into a tree is depicted. Those skilled in the art will recognize that while the threading of the J-shaped lag screw into a tree is depicted and described herein, the unthreading of the J-shaped lag screw is simply the reverse operation. To begin to thread the J-shaped lag screw S into a tree, one loops the closed loop 13 over the toe T of the foot portion F until the closed loop 13 is positioned about the smooth shank adjacent the threaded portion of the screw, as shown in FIG. 3. From this position, one then rotates the combination wrench 10 in the direction of the direction arrow 41. In doing so, the end 12 of the elongate central handle 11 engages the end or toe of the J-shaped lag screw and drives it in rotation in the direction of the direction arrow 41. In this way, the J-shaped lag screw is threaded into the tree. Note that by using the closed loop portion of the combination wrench, should the user's hands slip from the combination wrench, the combination wrench remains attached to the lag screw and keeps the combination wrench from inadvertently falling to the ground where it can cause property damage or injure someone. Also, this avoids the operator from having to climb down from the tree, retrieve the wrench, and climb back up again to begin threading the lag screw in once again.

This threading of the J-shaped lag screw into the tree continuous for a time. However, before the lag screw is fully threaded into the tree such that the outer surface of the three closes off the foot of the J-shaped lag screw, the operator would slip the closed loop portion 13 off of the foot F and turn the wrench around. The operator would then insert the hook portion 23 and continue to rotate in the direction of direction arrow 41 until the J-shaped lag screw is fully threaded into the tree as depicted in FIG. 4, with the toe T bearing against the outside surface of the tree. The combination wrench 10 can then be disengaged from the lag screw by simply slipping the hook 23 out from the within the foot F of the J-shaped lag screw. As mentioned briefly above, to remove the J-shaped lag screw, the reverse procedure is employed.

As the J-shaped lag screw is threaded into or threaded out of the tree, the offset angle, such as offset angles 16 and 26, serve to protect the user's hands (in particular the user's knuckles) from brushing up against or impacting the tree. This is accomplished by keeping the user's hands a distance away from the tree as a result of the offset. This protection of the user's hands can also be achieved using the displacement offset arrangement depicted in FIG. 5.

While the invention has been described in preferred forms, those skilled in the art will recognize that many additions, deletions, and modifications can be made therein without departing from the spirit and the scope of the invention as set forth in the following claims.

What is claimed is:

1. A combination wrench for threading and unthreading a J-shaped lag screw into a pole-like object, said combination wrench comprising:

(a) an elongate wrench shaft having first and second ends opposite each other;

(b) loop means adjacent said first end and defining a smooth bore for engagement over an end of a J-shaped lag screw to enable a user of said combination wrench to turn the J-shaped lag screw while preventing said combination wrench from falling should the user's hand slip off said combination wrench; and (c) hook means adjacent said second end for engagement of a portion of the J-shaped lag screw to enable a user of said combination wrench to turn the J-shaped lag screw in close proximity to the pole-like object.

2. A combination wrench as claimed in claim 1 wherein said loop means comprises a substantially closed loop adapted to be looped over an end of a J-shaped lag screw, and wherein said hook means comprises a hook adapted to engage the J-shaped lag screw.

3. A combination wrench as claimed in claim 2 wherein said hook and said loop are each offset from said elongate wrench shaft to provide hand clearance between said elongate wrench shaft and the object as the lag screw is turned.

4. A combination wrench as claimed in claim 3 wherein said hook and said loop are each oriented at an acute angle with respect to a longitudinal axis of said elongate wrench shaft.

5. A combination wrench as claimed in claim 3 wherein said hook and said loop are each oriented to be parallel to and spaced from a longitudinal axis of the elongate wrench shaft.

6. A combination wrench as claimed in claim 2 wherein said loop comprises an eyelet forming a circular aperture adapted to generally match the shaft of the lag screw.

7. A combination wrench as claimed in claim 2 wherein said hook is in the form of a part of a circle having a radius adapted to receive a portion of the lag screw.

8. A combination wrench as claimed in claim 2 wherein said hook is offset from said elongate wrench shaft to provide hand clearance between said elongate wrench shaft and the object as the lag screw is turned.

9. A combination wrench as claimed in claim 2 wherein said loop is offset from said elongate wrench shaft to provide hand clearance between said elongate wrench shaft and the object as the lag screw is turned.

10. A combination wrench as claimed in claim 1 wherein said smooth bore is substantially circular.

* * * * *